US007758451B2

(12) United States Patent
Liang et al.

(10) Patent No.: US 7,758,451 B2
(45) Date of Patent: Jul. 20, 2010

(54) WEIGHT ADJUSTING STRUCTURE OF GOLF CLUB HEAD

(75) Inventors: Ming-Ching Liang, Anding Township (TW); Tien-Ken Liang, Anding Township (TW); Scott A. Rice, San Diego, CA (US); Thomas C. Morris, Carlsbad, CA (US); Peter L. Soracco, Carlsbad, CA (US)

(73) Assignee: Cobra Golf, Inc, Carlsbad, CA (US)

( * ) Notice: Subject to any disclaimer, the term of this patent is extended or adjusted under 35 U.S.C. 154(b) by 123 days.

(21) Appl. No.: 12/036,709

(22) Filed: Feb. 25, 2008

(65) Prior Publication Data

US 2009/0215551 A1 Aug. 27, 2009

(51) Int. Cl.
*A63B 53/04* (2006.01)
*A63B 53/06* (2006.01)

(52) U.S. Cl. ..... 473/334; 473/349

(58) Field of Classification Search ..... 473/233, 473/256, 324–350

See application file for complete search history.

(56) References Cited

U.S. PATENT DOCUMENTS

| | | | | | |
|---|---|---|---|---|---|
| 2,098,445 | A | * | 11/1937 | Wettlaufer | 473/333 |
| 2,171,383 | A | * | 8/1939 | Wettlaufer | 473/335 |
| D154,496 | S | * | 7/1949 | Klein | D21/750 |
| 3,199,874 | A | * | 8/1965 | Blasing | 473/244 |
| 4,529,204 | A | * | 7/1985 | Yamakawa | 473/256 |
| 5,476,262 | A | * | 12/1995 | Bandiero | 473/409 |
| 5,683,309 | A | * | 11/1997 | Reimers | 473/337 |
| 5,916,042 | A | * | 6/1999 | Reimers | 473/334 |
| 6,089,994 | A | * | 7/2000 | Sun | 473/338 |
| 7,004,852 | B2 | * | 2/2006 | Billings | 473/332 |
| 7,052,410 | B2 | * | 5/2006 | Cameron | 473/245 |
| 7,070,514 | B1 | * | 7/2006 | Borunda | 473/333 |
| 7,108,609 | B2 | * | 9/2006 | Stites et al. | 473/256 |
| 7,384,345 | B2 | * | 6/2008 | Sherman | 473/249 |
| 7,404,772 | B2 | * | 7/2008 | Koide et al. | 473/334 |
| 7,448,962 | B2 | * | 11/2008 | Kusumoto | 473/334 |
| 2003/0232659 | A1 | * | 12/2003 | Mahaffey et al. | 473/256 |
| 2004/0176177 | A1 | * | 9/2004 | Mahaffey et al. | 473/256 |
| 2005/0148406 | A1 | * | 7/2005 | Mahaffey et al. | 473/345 |
| 2006/0247071 | A1 | * | 11/2006 | Womersley | 473/340 |

FOREIGN PATENT DOCUMENTS

| | | | |
|---|---|---|---|
| JP | 11319167 | A | * 11/1999 |
| JP | 2006223788 | A | * 8/2006 |
| JP | 2006320493 | A | * 11/2006 |

* cited by examiner

*Primary Examiner*—Alvin A Hunter
(74) *Attorney, Agent, or Firm*—Knobbe, Martens, Olson & Bear LLP

(57) ABSTRACT

A weight adjusting structure of a golf club head comprises a 360-degree rotatable rotary table installed in a body of a golf club head, wherein the rotary table is combined with an incomplete annular weight block at a peripheral portion on an arbitrary side thereof, so that the rotary table and the weight block form a rotary table assembly whose weight orientation can be adjusted. The weighted rotary table assembly installed in the body of the golf club head can be used to adjust a distribution of different weights around 360 degrees, whereby a preferred location of the club head's gravity center can be set according to a golfer's swing posture and a location of the club head's gravity center the golfer is used to.

14 Claims, 10 Drawing Sheets

I-I

II-II

III-III

IV-IV

V-V

WEIGHT ADJUSTING STRUCTURE OF GOLF CLUB HEAD

BACKGROUND OF THE INVENTION

1. Technical Field

The present invention relates to a weight adjusting structure of a golf club head, and more particularly to a weight adjusting structure of a golf club head comprising a club head assembly which is installed in the golf club head and can be rotated 360 degrees for adjusting a weight orientation thereof, so that the gravity center of the club head can be located to suit a golfer's swing posture and habits.

2. Description of Related Art

For a golfer to change the weight orientation of a golf club head to suit his personal swing posture and the location of the gravity center, a weight block has been installed at a lower portion of the club head during the manufacturing process by a golf club manufacturer in an exposed form, so that the weight orientation of the club head can be adjusted with the weight block. The position of the weight block can be shifted to adjust the gravity center of the club head according to the golfer's swing posture and habits. However, since the weight block is exposed at the lower portion of the club head, the club head presents an odd look.

SUMMARY OF THE INVENTION

The present invention is an improvement over the existing weight block assembly installed in a golf club head, with the aims of providing a club head assembly installed in a club head that can be rotated 360 degrees to adjust a weight orientation thereof, so that a location of the gravity center can be set to suit a golfer's swing posture and habits.

The primary objective of the present invention is to provide a 360-degree rotatable rotary table installed in a body of a golf club head, wherein the rotary table is combined with an incomplete annular weight block at a peripheral portion on an arbitrary side thereof, so that the rotary table and the weight block form a rotary table assembly whose weight orientation can be adjusted. The weighted rotary table assembly installed in the body of the golf club head can be used to adjust a distribution of different weights around 360 degrees, so that a preferred location of the club head's gravity center can be set according to a golfer's swing posture and to a location that the golfer is used to.

The secondary objective of the present invention is to provide a weighted rotary table assembly installed in a body of a golf club head, wherein an orientation adjustment of the weighted rotary table assembly is limited by a locking block assembly, and the locking block assembly comprises a locking block having a pin extending from a side thereof. The pin is connected with a resilient element that is constantly pressed upwards, and then penetrates into the body of the club head so as to be retained by a C-shaped fastener. Meanwhile, an engaging portion protruding from a peripheral portion of the locking block towards an acting side thereof can be engaged with or disengaged from slots distributed around a lower periphery of the weighted rotary table. While the locking block assembly is in ordinary use, the engaging portion formed at an end of the locking block is engaged with one of the slots distributed around the lower periphery of the weighted rotary table, so that the weighted rotary table assembly is in a locked state. When the weighted rotary table assembly is operated for an orientation adjustment, the resiliently secured locking block is manually pushed upwards to drive the engaging portion protruding therefrom to disengage from the slot on the lower periphery of the weighted rotary table, so that the weighted rotary table assembly is in a free state.

The tertiary objective of the present invention is to provide a weighted rotary table assembly installed in a body of a golf club head, wherein an orientation adjustment of the rotary table assembly is limited by a locking block assembly and the locking block assembly has a butting portion at an end thereof. The butting portion can be inserted through a gauging member providing graduated spaces and combined with a resilient element that is constantly pressed inwards, and then penetrates into a side peripheral portion of the body of the club head so as to be retained by a C-shaped fastener, so that the butting portion of the locking block is engaged with, or disengaged from, notches distributed around a periphery of the weighted rotary table. While the locking block assembly is in ordinary use, the butting portion of the locking block is engaged with one of the notches distributed around the periphery of the weighted rotary table, so that the weighted rotary table assembly is in a locked state. When the weighted rotary table assembly is operated for an orientation adjustment, the locking block which is resiliently pressed inwards is rotated with a tool to drive the gauging member to rotate to a small spacing, so that the butting portion of the locking block is disengaged from the notch on the periphery of the weighted rotary table. Thus, the weighted rotary table assembly enters a free state.

The fourth objective of the present invention is to provide a weighted rotary table assembly installed in a body of a golf club head, wherein an orientation adjustment of the rotary table assembly is limited by a locking block. More particularly, a screw portion formed at an end of the locking block can directly penetrate into a side peripheral portion of the body of the club head, so that the screw portion of the locking block is screwed into, or out of, threaded holes distributed around a periphery of the weighted rotary table. While the locking block is in ordinary use, the screw portion is screwed in one of the threaded holes distributed around the periphery of the weighted rotary table, so that the weighted rotary table assembly is in a locked state. When the weighted rotary table assembly is operated for an orientation adjustment, the locking block is rotated outwards with a tool to drive the screw portion to disengage from the threaded hole on the periphery of the weighted rotary table. Thus, the weighted rotary table assembly enters a free state.

The fifth objective of the present invention is to provide a weighted rotary table assembly installed in a body of a golf club head, wherein the rotary table assembly is covered on a top portion thereof with an upper body, so that the entire golf club head has a decorative top surface.

The sixth objective of the present invention is to provide a golf club head having a body which comprises a supporting tube, wherein the supporting tube can cooperate with a threaded securing element and be combined with a bush, so as to be penetratingly assembled with a weighted rotary table assembly. Thus, the weighted rotary table assembly installed in the body of the club head enters a pivotally installed state.

The seventh objective of the present invention is to provide a golf club head having a body which is formed with a cavity on a side thereof for receiving a spring and a ball. Meanwhile, a weighted rotary table assembly installed in the body of the club head has a plurality of notches distributed around a lower periphery thereof. Therefore, the ball which is received in the cavity of the body and constantly pressed upwards can be resiliently engaged with a positionally corresponding one of the notches on the lower periphery of the weighted rotary table assembly to assist in positioning the weighted rotary table assembly.

DETAILED DESCRIPTION OF THE PREFERRED EMBODIMENT

Figure 2:
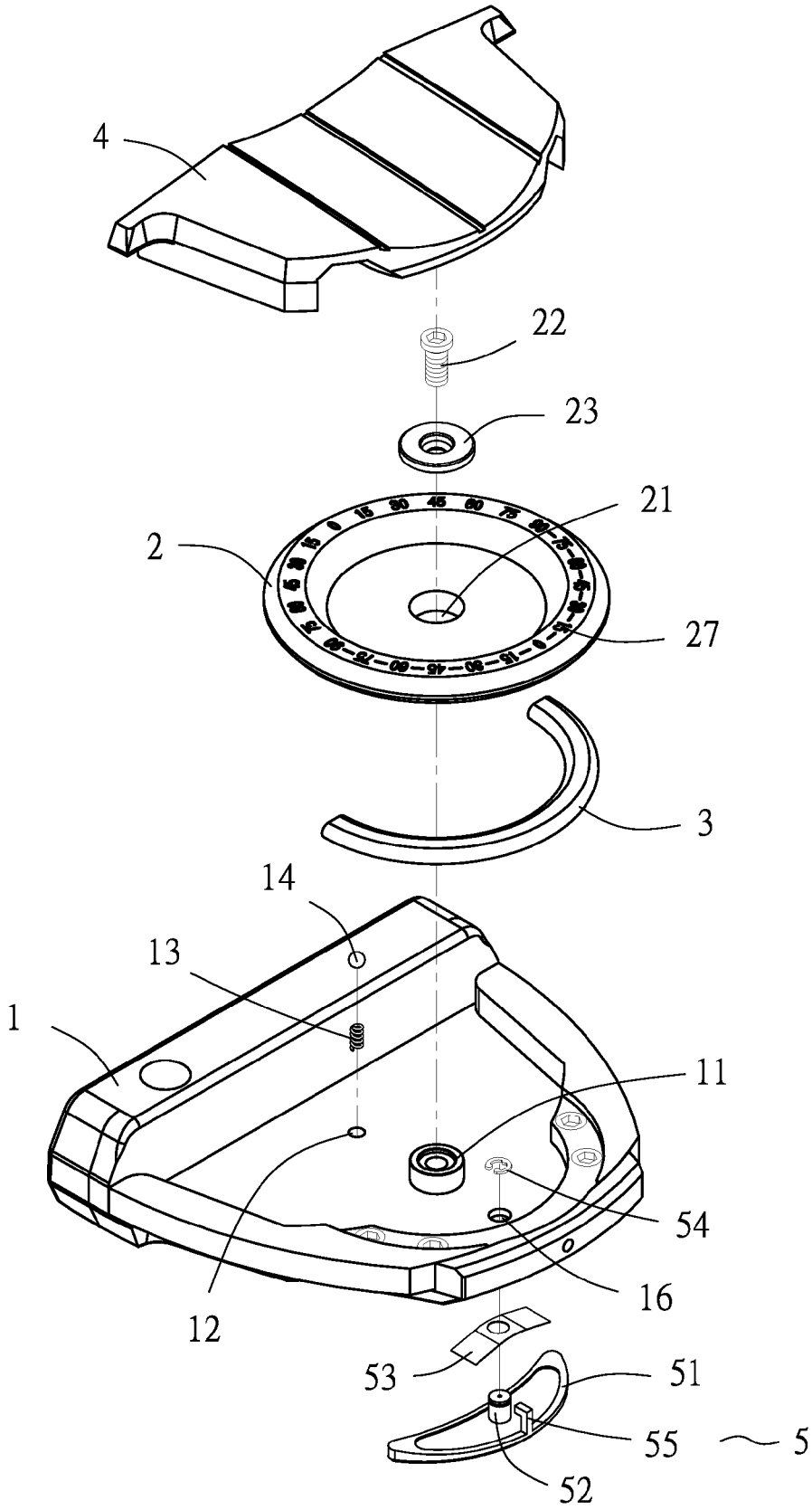
FIG. 2 is a perspective exploded view of a first embodiment of the golf club head according to the present invention.
Figure 3:
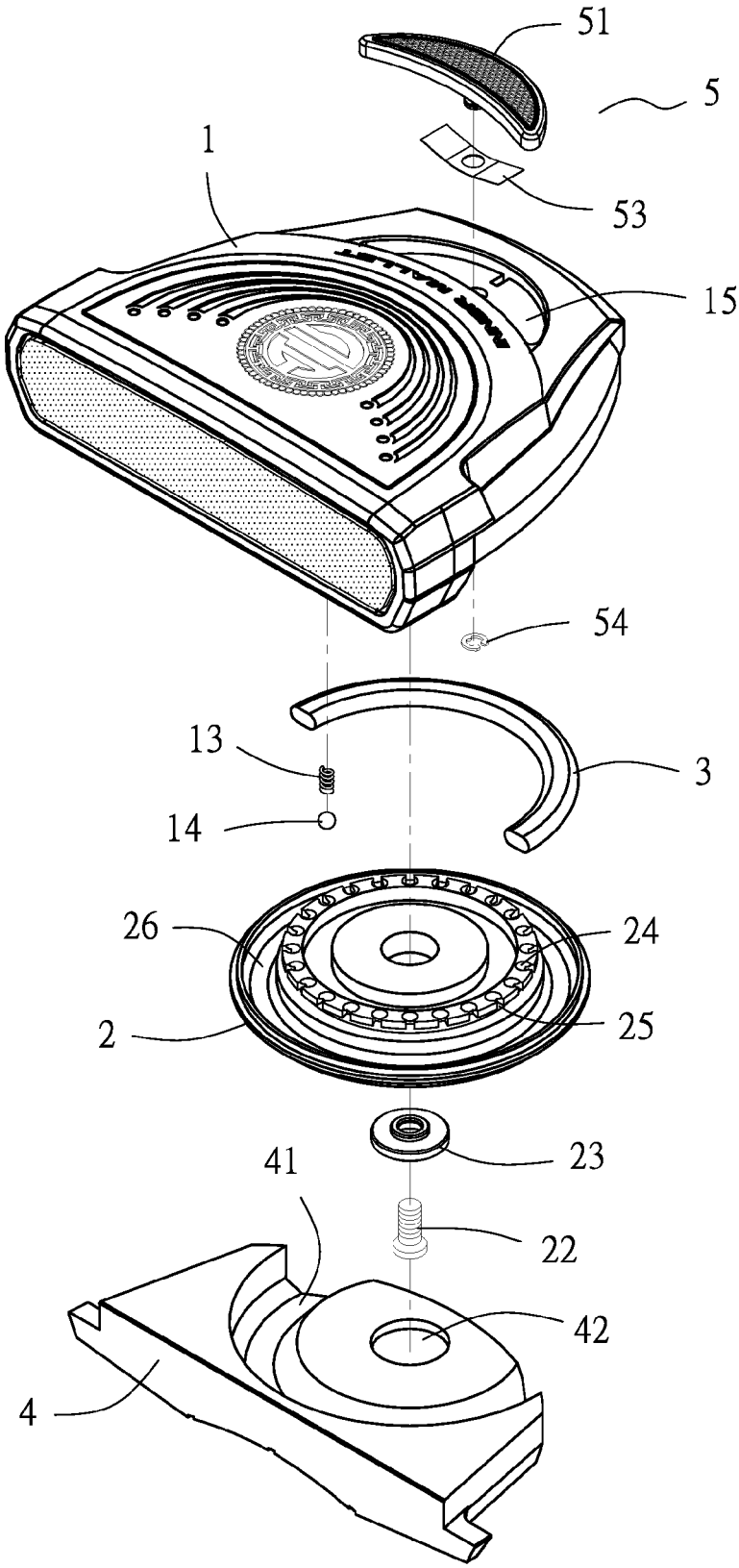
FIG. 3 is another perspective exploded view of the first embodiment of the golf club head according to the present invention, showing components thereof from an opposite viewing angle.

Referring to FIGS. 2 and 3, a weight adjusting structure of a golf club head according to a first embodiment of present invention comprises a body 1, a rotary table 2 with a weight block 3, an upper body 4, and a locking block assembly 5.

Figure 4A:
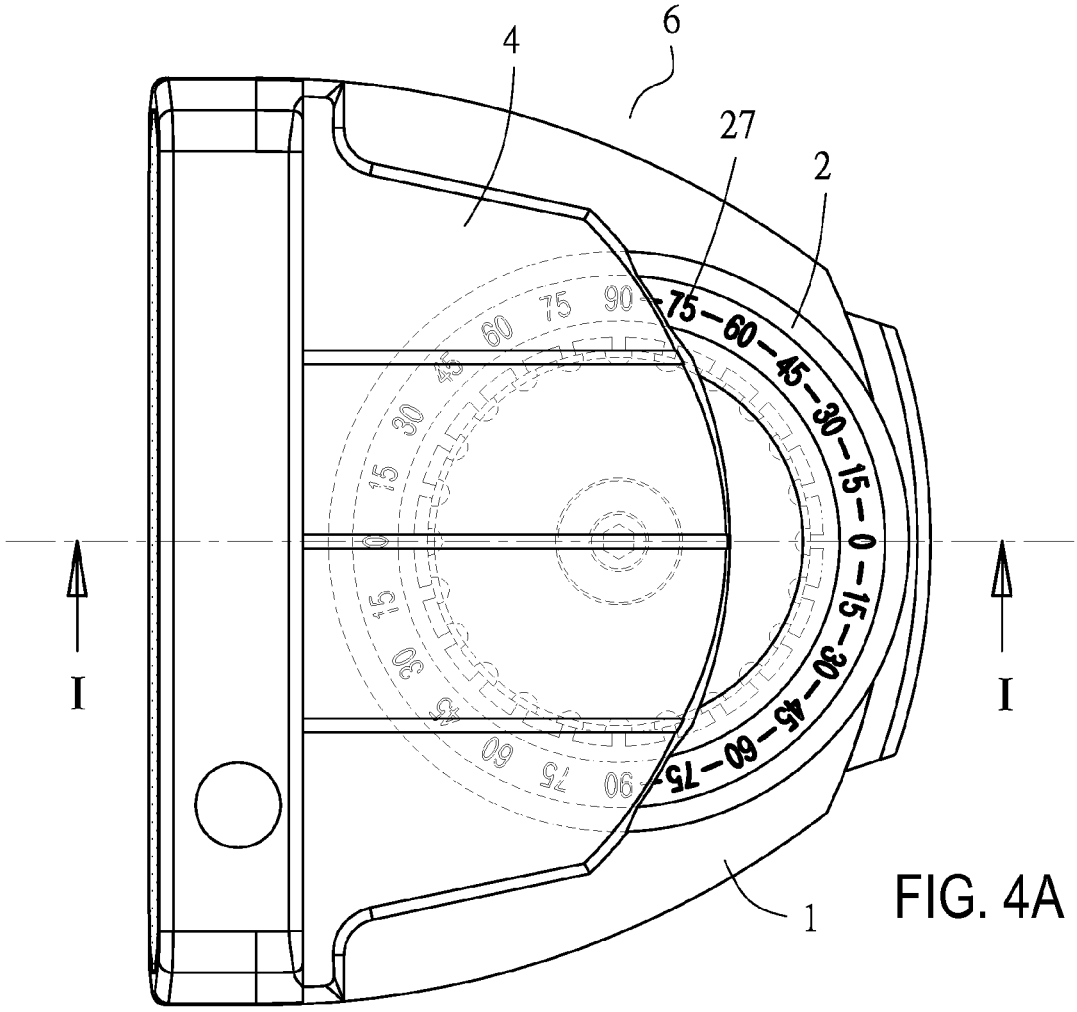
FIG. 4A is a top view and FIG. 4B is a corresponding cross-sectional view of a rotary table assembly in the first embodiment of the golf club head according to the present invention, wherein the rotary table assembly is in a locked state.

The body 1 has a supporting tube 11 protruding therefrom and a cavity 12 formed on a side thereof for receiving a spring 13 and a ball 14, as shown in the detailed cross-sectional view taken along Line I-I in FIG. 4A. The body 1 further has a concave portion 15 formed distally on a lower side thereof for receiving the locking block assembly 5.

The rotary table 2 has a hole 21 in a central portion thereof for receiving a threaded securing element 22 therethrough after the threaded securing element 22 is combined with a bush 23, so that an end of the threaded securing element 22 is screwed into the supporting tube 11 protruding from the body 1, as shown in the detailed cross-sectional view taken along Line I-I in FIG. 4A. In addition, as shown in FIG. 3, the rotary table 2 has a plurality of notches 24 distributed around a lower periphery thereof, wherein each of the notches 24 is formed with a slot 25 extending outwards. Moreover, an annular groove 26 is provided at a peripheral portion on an arbitrary side of the rotary table 2 for combining therein an incomplete annular weight block 3. (In this embodiment, the annular groove 26 is formed on a bottom side of the rotary table 2, wherein the weight block 3 and the rotary table 2 are combined by covering or gluing the weight block 3 in place.) The rotary table 2 is further provided with a scale 27 of 360 degrees on a periphery of an upper side thereof for easy visual reference by a user trying to make adjustments.

The upper body 4 has an arcuate channel 41 formed on a lower side thereof for receiving the rotary table 2 during assembly. At a center of the arcuate channel 41 formed on the upper body 4 is a concave portion 42 for receiving the bush 23 mounted to a rod portion of the threaded securing element 22 during assembly.

The locking block assembly 5 comprises a locking block 51 which has a pin 52 extending from a side thereof for combining with a resilient element 53 that is constantly pressed upwards. During assembly, the locking block 51 is placed into the concave portion 15 formed at the lower portion of the body 1, as shown in the detailed cross-sectional view taken along Line I-I in FIG. 4A. Next, the pin 52 of the locking block 51 is inserted through a hole 16 on the body 1 so as to be retained by a C-shaped fastener 54. The locking block 51 further has an engaging portion 55 protruding from a peripheral portion of the locking block 51 towards an acting side thereof. The engaging portion 55 can be engaged with or disengaged from the slots 25 extending outwards from the notches 24 distributed around the lower periphery of the rotary table 2, which is combined with the weight block 3 on a side thereof.

Referring to FIGS. 4A, 4B, 5A and 5B, the golf club head is assembled in the following way. Firstly, the threaded securing element 22 is combined with the bush 23 and then inserted through the central hole 21 of the rotary table 2, which is combined with the weight block 3 on a side thereof. Then, an end of the threaded securing element 22 is screwed into the supporting tube 11 protruding from the body 1, as shown in the detailed cross-sectional view taken along Line I-I in FIG. 4A, so that the ball 14 which is received in the cavity 12 of the body 1 and constantly pressed upwards is resiliently engaged with a positionally corresponding one of the notches 24 on the lower portion of the rotary table 2, which has the weight block 3 attached thereon, to assist in positioning the weighted rotary table 2 assembly. Next, the pin 52 extending from a side of the locking block 51 is combined with the resilient element 53 that is constantly pressed upwards, so that the locking block 51 can be disposed stably in the concave portion 15 formed on the lower side of the body 1, as shown in the detailed cross-sectional view taken along Line I-I in FIG. 4A.

Figure 1:
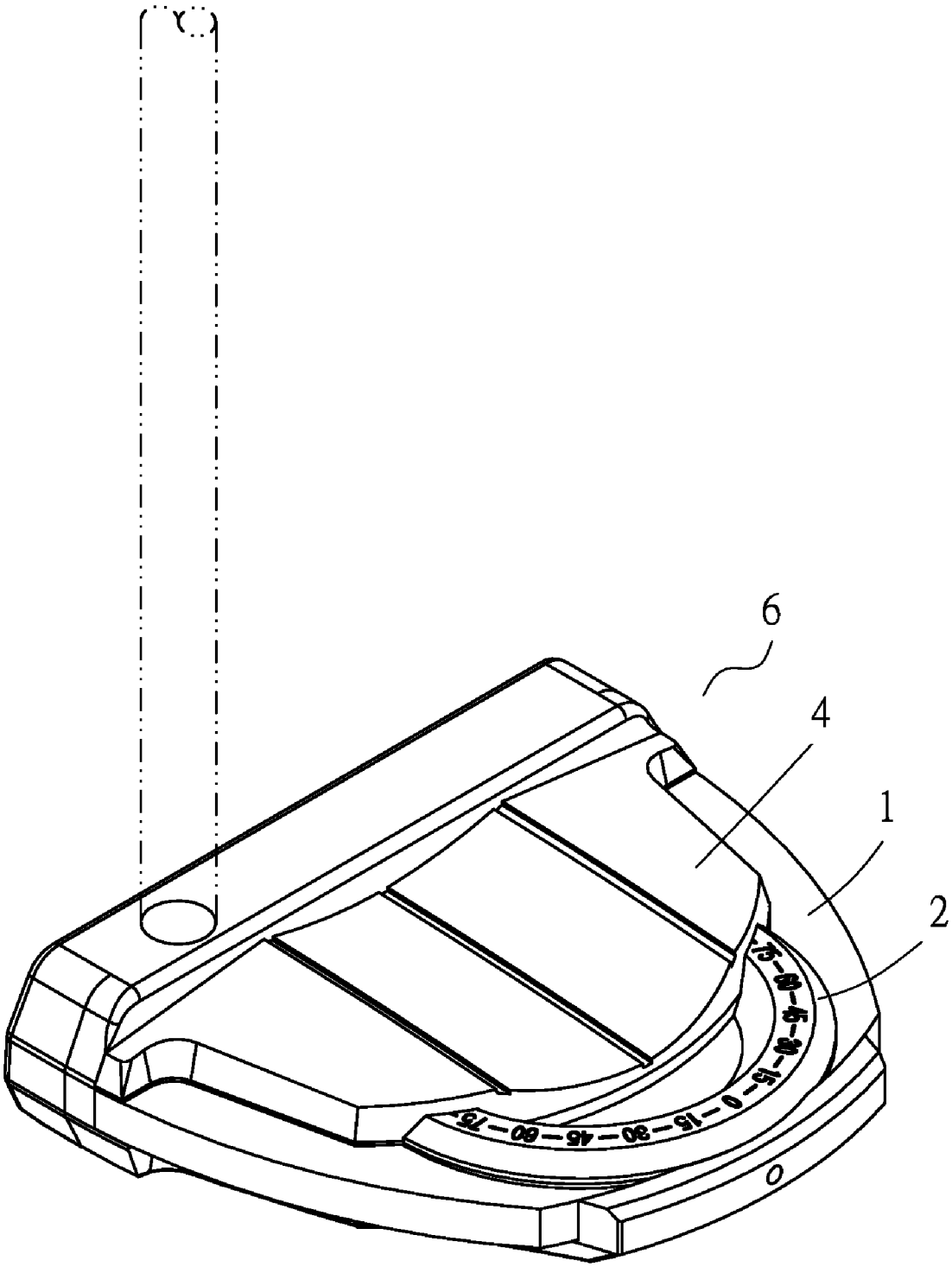
FIG. 1 illustrates an assembled appearance of a golf club head according to the present invention.
Figure 4B:
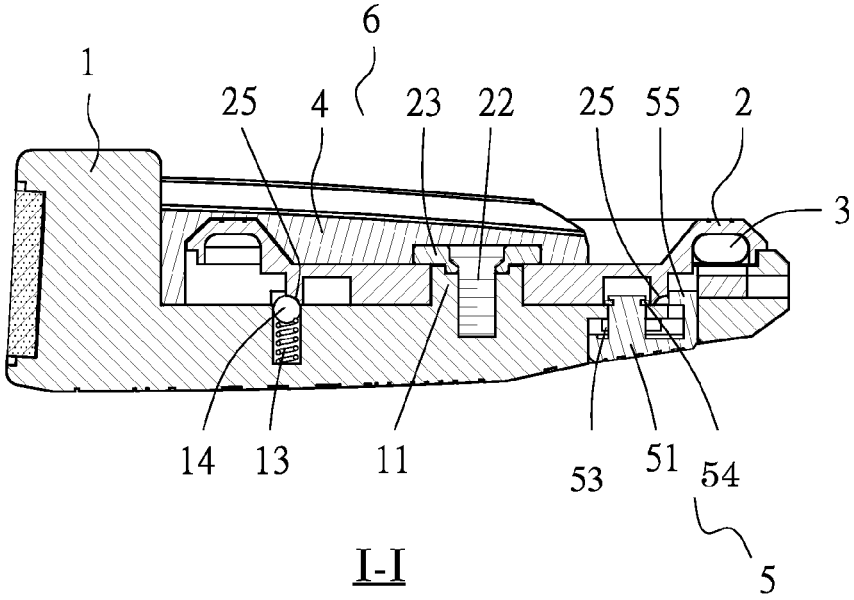

Then, the pin 52 on the locking block 51 is inserted through the body 1 of the club head and retained by the C-shaped fastener 54, while the engaging portion 55 protruding from the locking block 51 towards the acting side thereof is engaged with one of the slots 25 extending outwards from the notches 24 distributed around the lower portion of the rotary table 2, which is combined with the weight block 3 on a side thereof. After that, the upper body 4 is placed on a corresponding periphery of the body 1 to partially cover the rotary table 2, which has the weight block 3 attached thereon, as shown in FIGS. 4A and 4B. Finally, adjacent peripheries of the upper body 4 and the body 1 are positioned and connected (by bonding with an adhesive, for example) to form a golf club head 6 that allows for adjustment of a distribution of different weights around 360 degrees. (The golf club head shown in FIG. 1 can be combined with a shaft on a side thereof.)

Figure 5A:
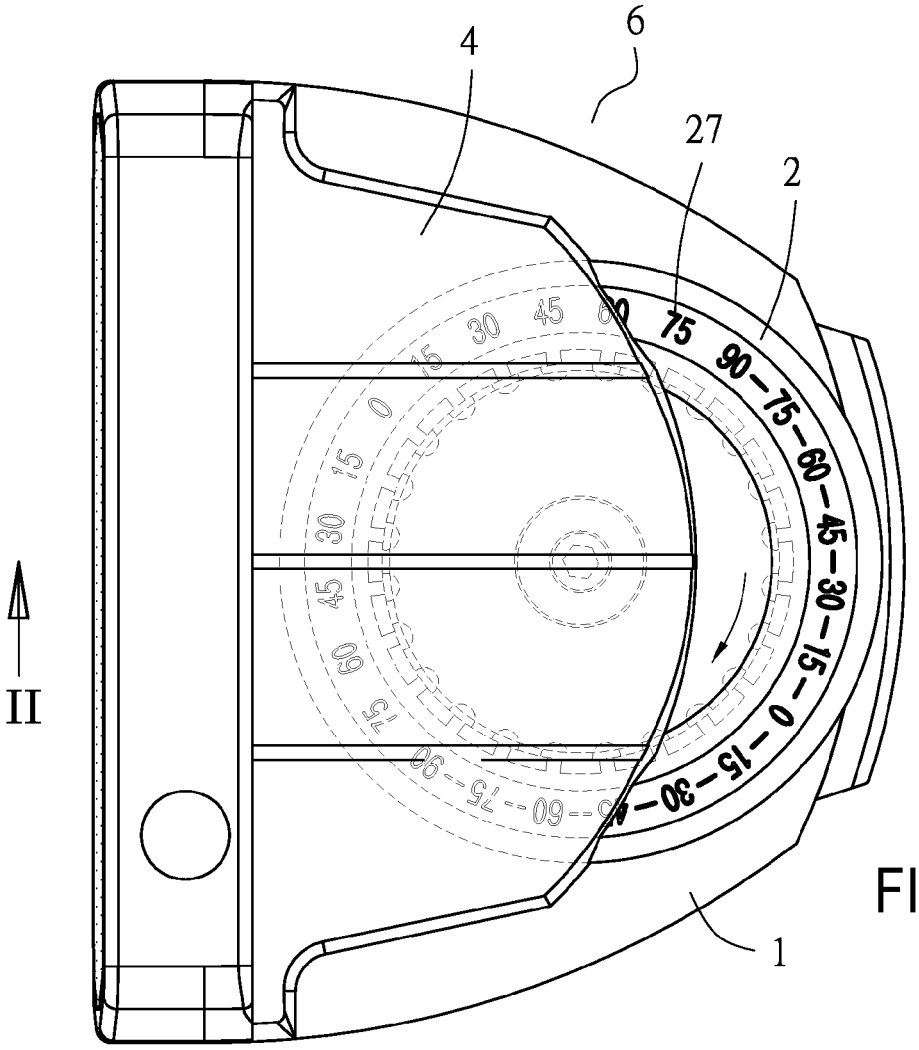
FIG. 5A is another top view and FIG. 5B is a corresponding cross-sectional view of the rotary table assembly in the first embodiment of the golf club head according to the present invention, wherein the rotary table assembly is in a free state.
Figure 5B:
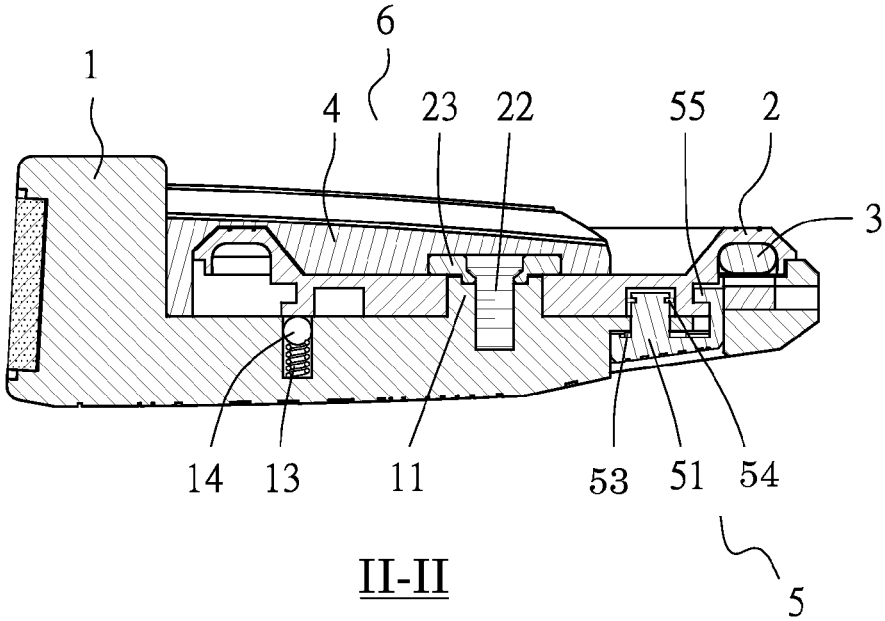

While the locking block assembly 5 installed in the golf club head 6 is in ordinary use, the engaging portion 55 protruding from an end of the locking block 51 is engaged with the slots 25 extending outwards from the notches 24 distributed around the lower portion of the weighted rotary table 2, as shown in the detailed cross-sectional view taken along Line I-I in FIG. 4A, so that the weighted rotary table 2 assembly is in a locked state. When the weighted rotary table 2 assembly is operated for an orientation adjustment, as shown in FIGS. 5A and 5B, the resiliently secured locking block 51 is manually pushed upwards to drive the engaging portion 55 protruding therefrom to move upwards, as shown in the detailed cross-sectional view taken along Line II-II in FIG. 5A, so as to disengage from the slot 25 extending outwards from the notches 24 distributed around the lower portion of the weighted rotary table 2. As a result, the weighted rotary table 2 assembly is in a free state, allowing a golfer to use the weighted rotary table 2 assembly to set a preferred location of the club head's gravity center according to the golfer's personal swing posture and a location that the golfer is used to.

Figure 6:
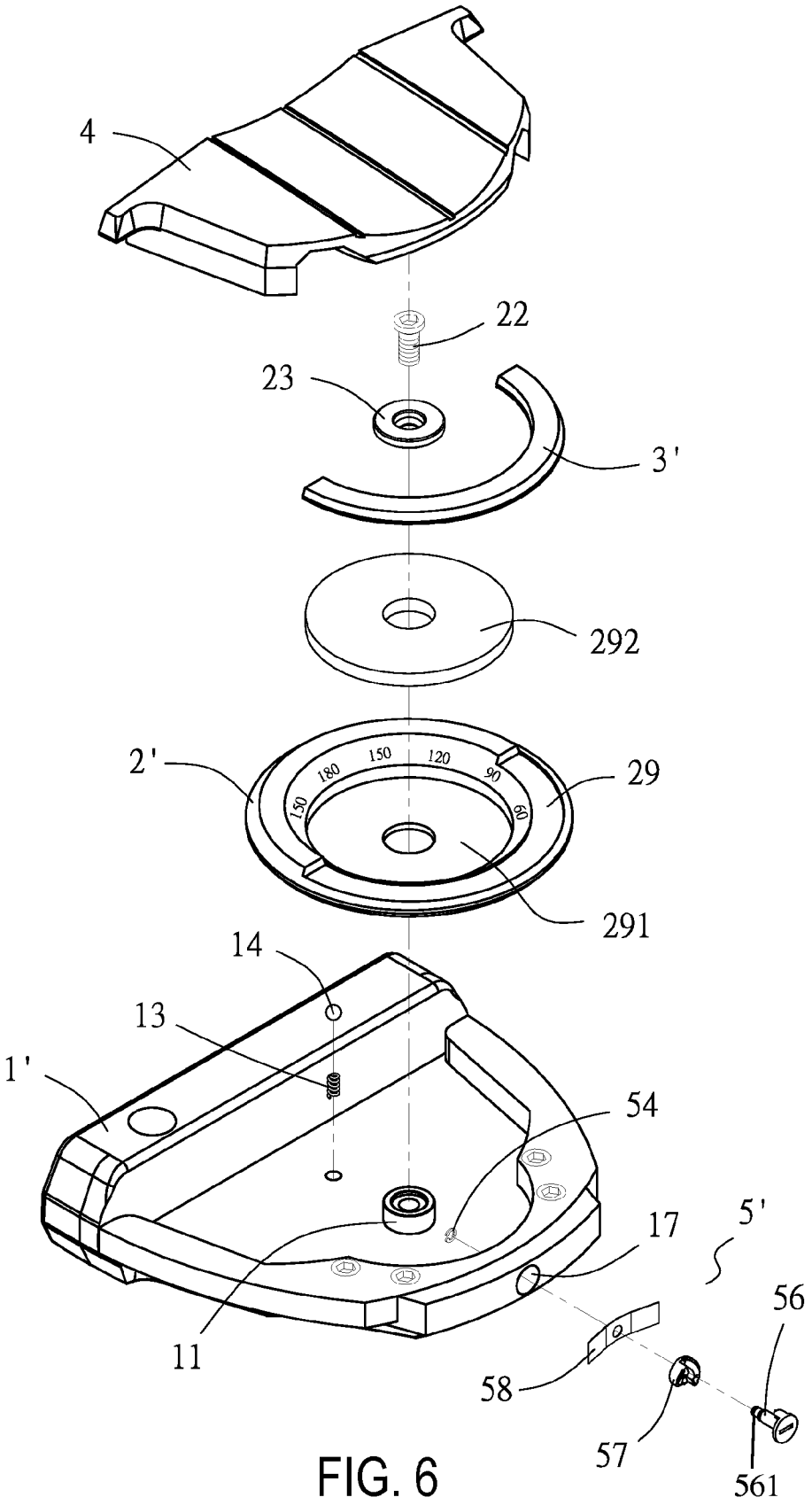
FIG. 6 is a perspective exploded view of a second embodiment of the golf club head according to the present invention.

Referring now to FIG. 6, a weight adjusting structure of a golf club head according to a second embodiment of the present invention also comprises a body 1', a rotary table 2' with a weight block 3', an upper body 4, and a locking block assembly 5'. The aforementioned components have similar configurations to those in the first embodiment while the differences therebetween are as follows.

The body 1' has a hole 17 formed on a distal peripheral portion thereof for receiving the locking block assembly 5' therethrough.

Figure 7A:
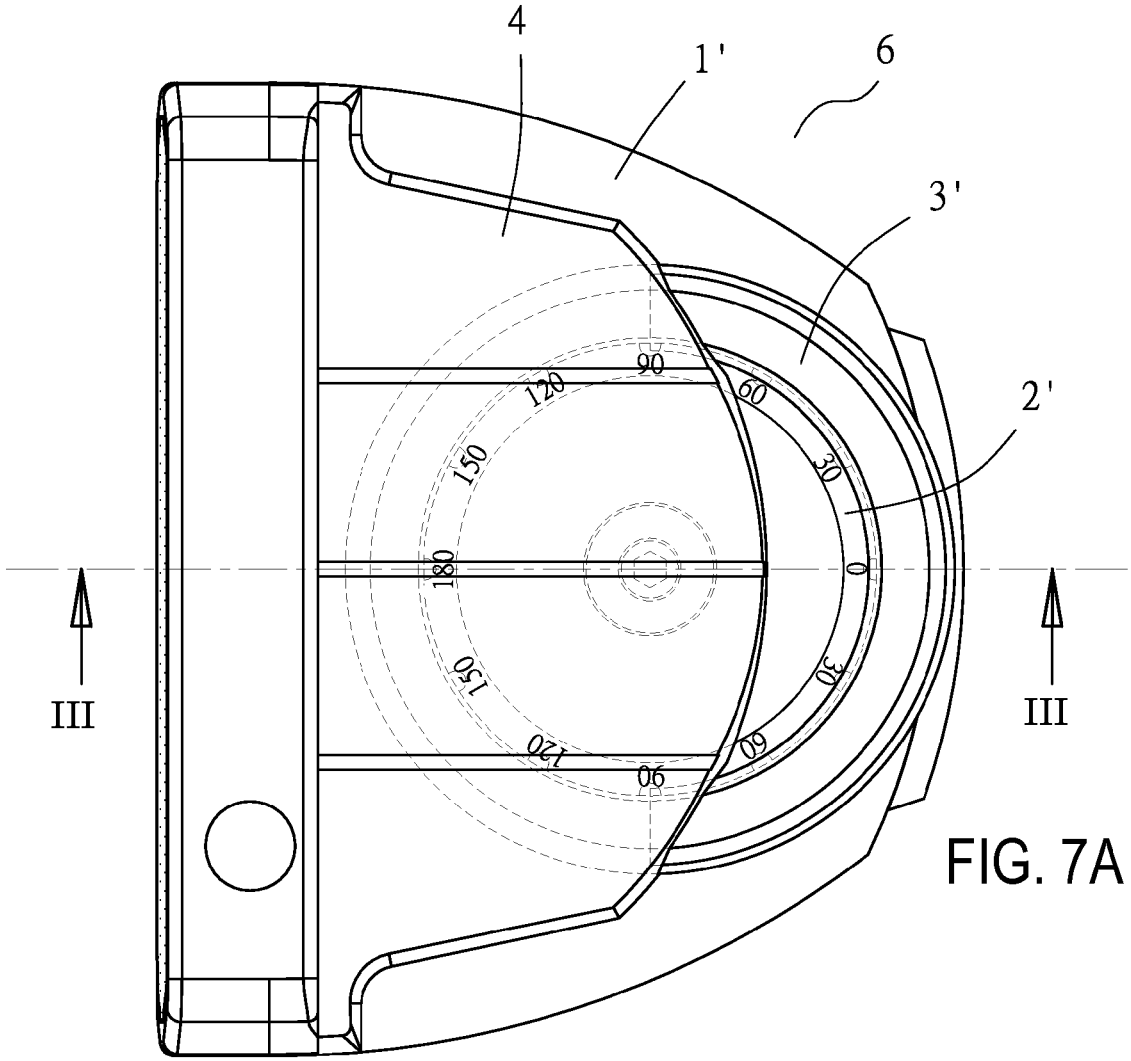
FIG. 7A is a top view and FIG. 7B is a corresponding cross-sectional view of a rotary table assembly in the second embodiment of the golf club head according to the present invention, wherein the rotary table assembly is in a locked state.

The rotary table 2' has an annular groove 28 on a lower periphery thereof and a plurality of notches 281 distributed around an inner surface of the annular groove 28, as shown in the detailed cross-sectional view taken along Line III-III in FIG. 7A. Moreover, the rotary table 2' has an incomplete annular recess 29 cut into a peripheral portion on an arbitrary side of the rotary table 2', for combining therein a matching weight block 3'. A decorative panel 292 can be installed in a concave space 291 formed on the rotary table 2'.

The locking block assembly 5' comprises a locking block 56 which has a butting portion 561 formed at an end thereof. The butting portion 561 is passed through a gauging member 57 providing graduated spaces, and combined with a resilient element 58 that is constantly pressed inwards, so that the butting portion 561 of the locking block 56 penetrates the hole 17 on the side peripheral portion of the body 1' and is retained by the C-shaped fastener 54, as shown in the detailed cross-sectional view taken along Line III-III in FIG. 7A. The butting portion 561 of the locking block 56 can be engaged with or disengaged from the notches 281 distributed around the periphery of the rotary table 2', which is combined with the weight block 3' on a side thereof.

Figure 7B:
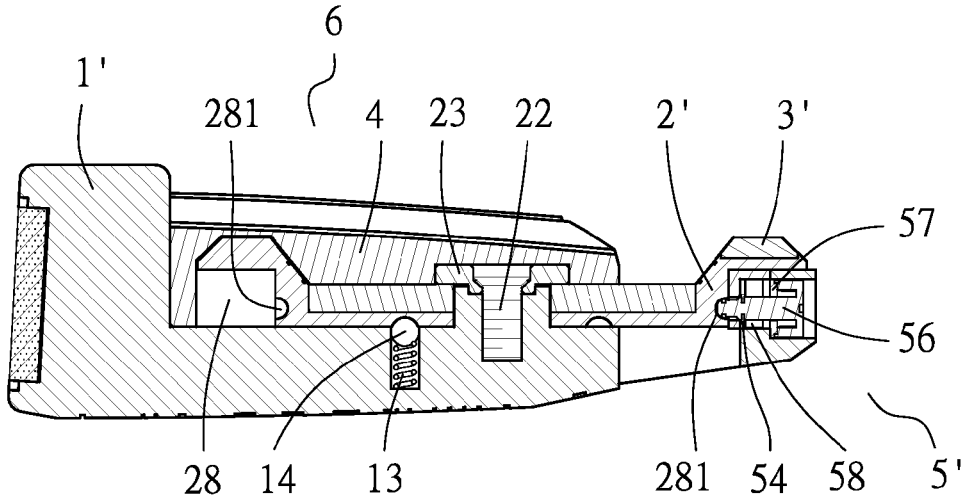
Figure 8A:
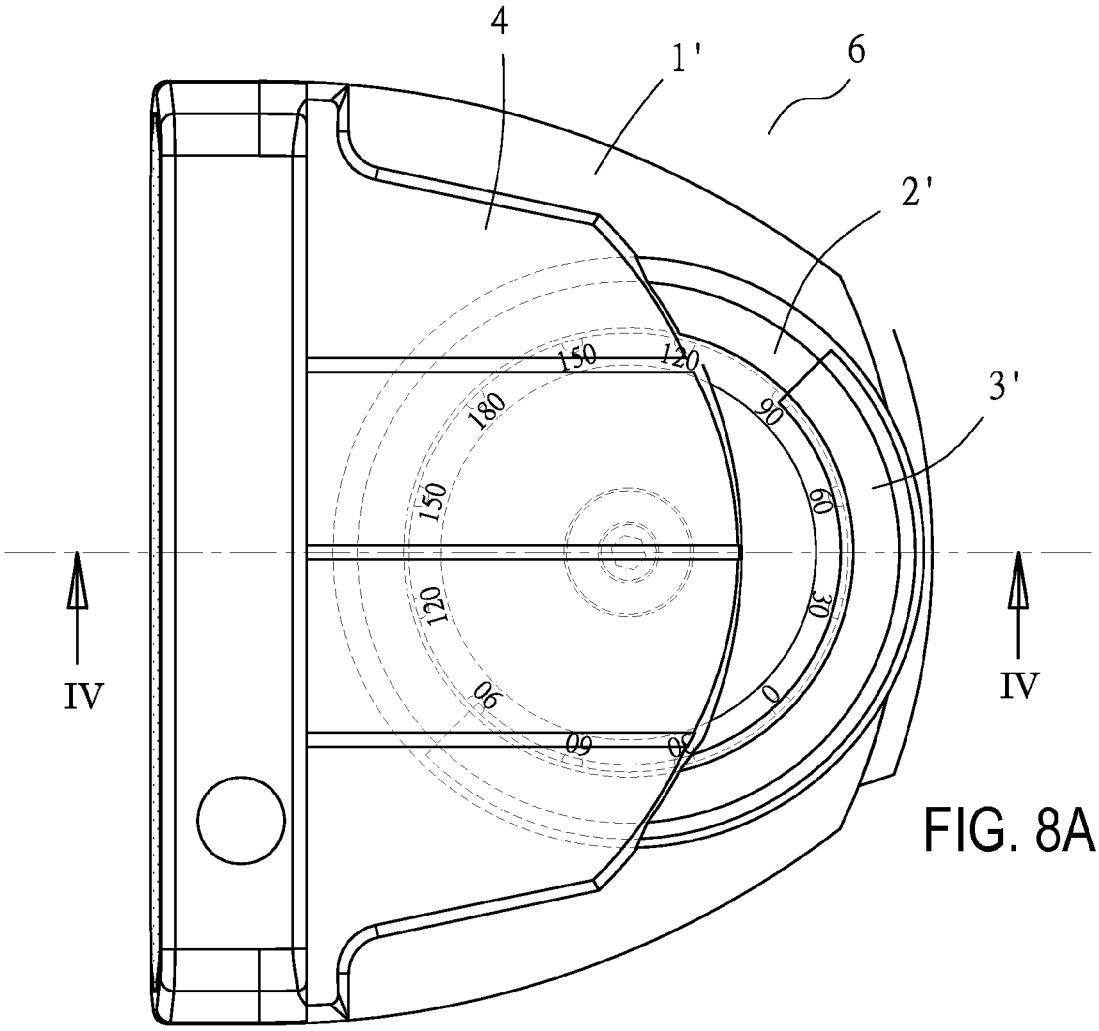
FIG. 8A is another top view and FIG. 8B is a corresponding cross-sectional view of the rotary table assembly in the second embodiment of the golf club head according to the present invention, wherein the rotary table assembly is in a free state.
Figure 8B:
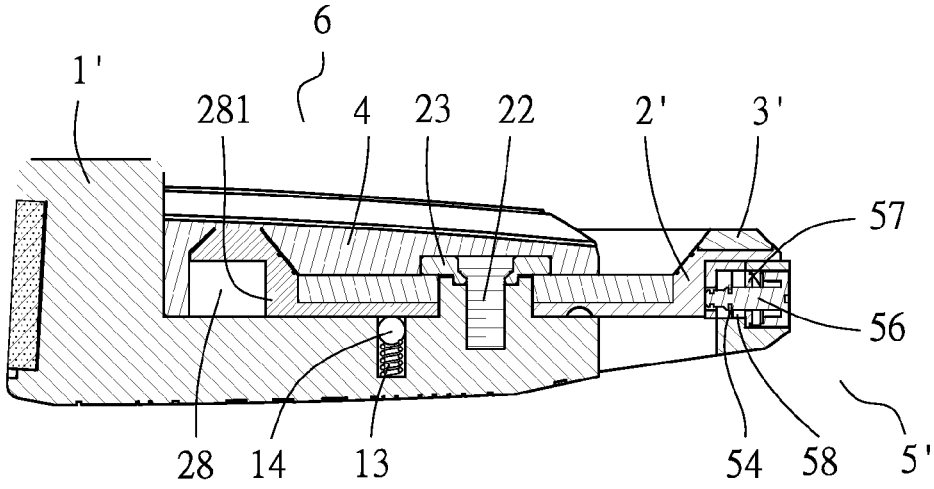

As shown in FIGS. 7A and 7B, the rotary table 2' having the weight block 3' attached thereon is installed on the supporting tube 11 of the body 1' via the threaded securing element 22 mounted with the bush 23, while the locking block assembly 5' is installed in the hole 17 formed on the distal peripheral portion of the body 1'. While the locking block assembly 5' is in ordinary use, the butting portion 561 of the locking block 56 is engaged with the notches 281 distributed around the periphery of the rotary table 2', which has the weight block 3' attached thereon, as shown in the detailed cross-sectional view taken along Line III-III in FIG. 7A, so that the weighted rotary table 2' assembly is in a locked state. When the rotary table 2' having the weight block 3' attached thereon is operated for an orientation adjustment, as shown in FIGS. 8A and 8B, the locking block 56 which is resiliently pushed inwards is rotated with a tool to drive the gauging member 57 providing the graduated spaces to rotate to a small spacing, as shown in the detailed cross-sectional view taken along Line IV-IV in FIG. 8A, so that the butting portion 561 of the locking block 56 is disengaged from the notches 281 distributed around the periphery of the weighted rotary table 2'. Thus, the weighted rotary table 2' assembly enters a free state.

Figure 9:
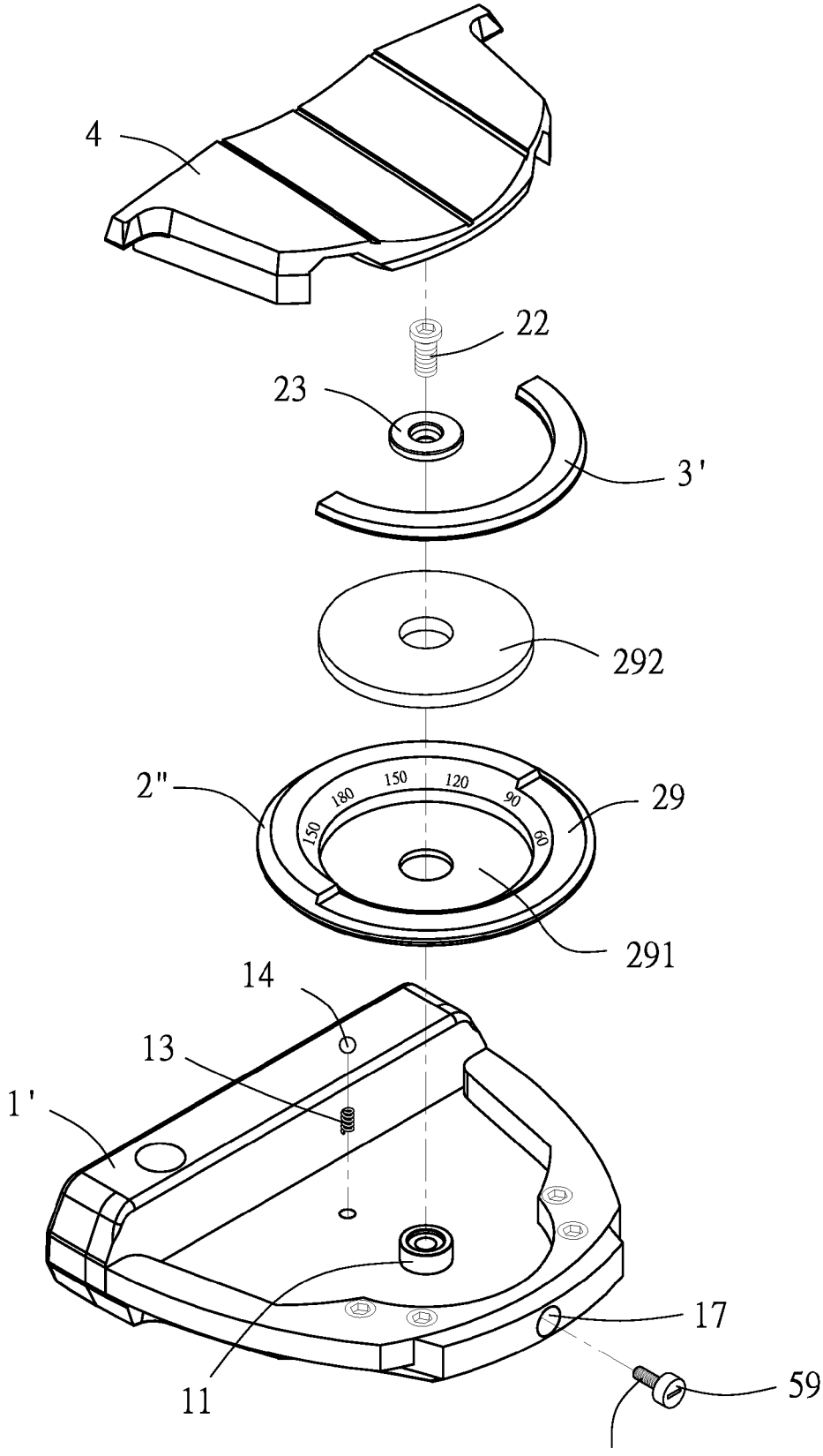
FIG. 9 is a perspective exploded view of a third embodiment of the golf club head according to the present invention.

Referring now to FIG. 9, a weight adjusting structure of a golf club head according to a third embodiment of the present invention also comprises a body 1', a rotary table 2" with a weight block 3', an upper body 4, and a locking block 59. The aforementioned components have similar configurations to those in the second embodiment while the differences therebetween are as follows.

Figure 10A:
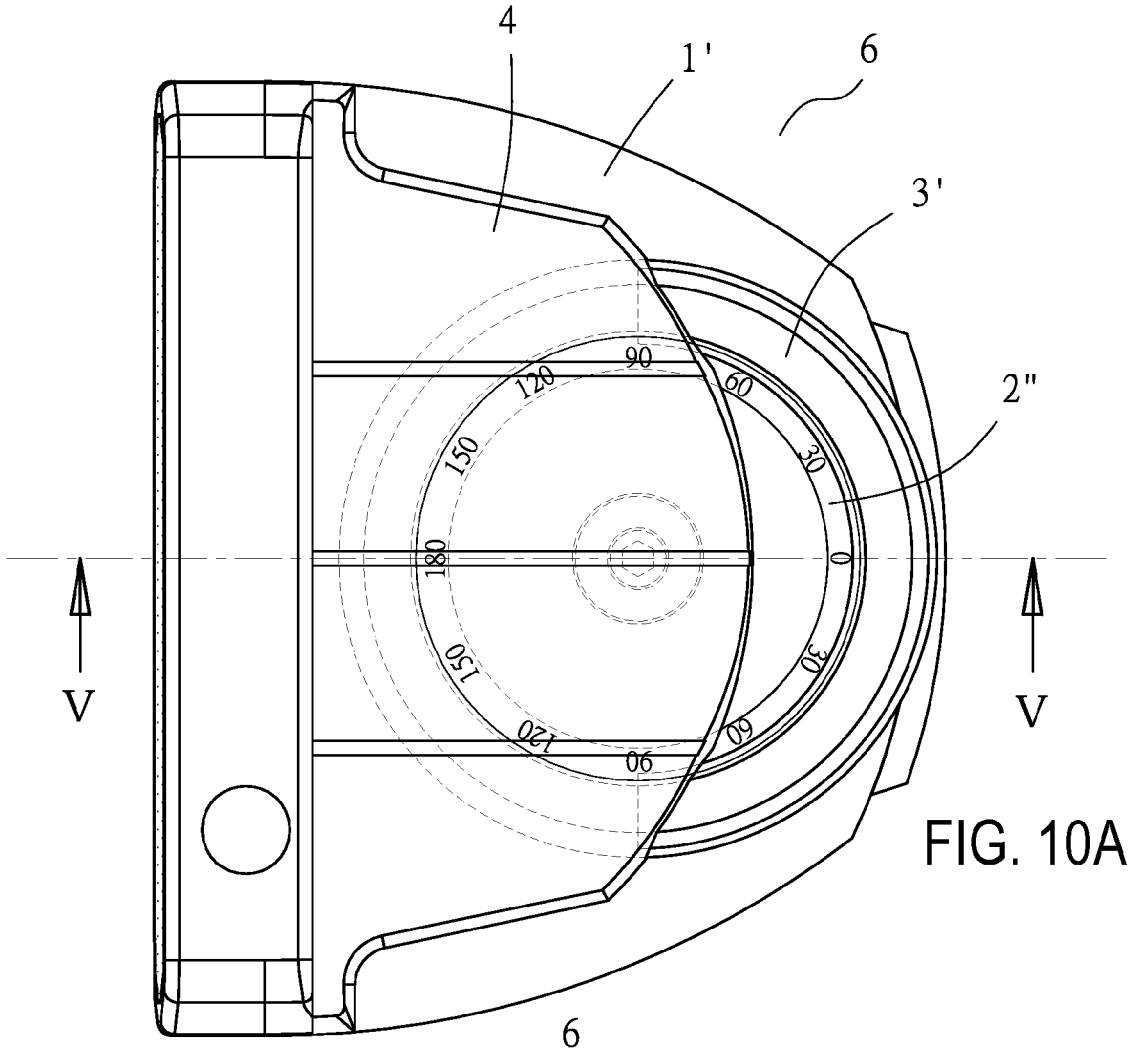
FIG. 10A is a top view and FIG. 10B is a corresponding cross-sectional view of a rotary table assembly in the third embodiment of the golf club head according to the present invention, wherein the rotary table assembly is in a locked state.

The rotary table 2" having a weight block 3' attached thereon is formed with a plurality of threaded holes 282 distributed around the inner surface of the annular groove 28, as shown in the detailed cross-sectional view taken along Line V-V in FIG. 10A.

Figure 10B:
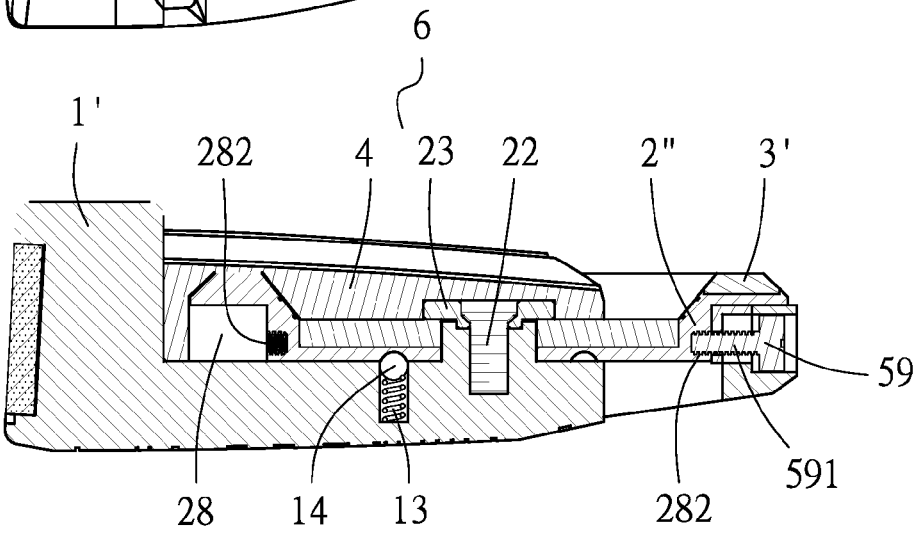

As shown in FIGS. 10A and 10B, the rotary table 2", having the weight block 3' attached thereon, is installed on the supporting tube 11 of the body 1' via the threaded securing element 22 mounted with the bush 23, while a screw portion 591 formed at an end of the locking block 59 is inserted directly through the hole 17 formed on the side peripheral portion of the body 1'. The screw portion 591 of the locking block 59 can be screwed into or out of the threaded holes 282 distributed around the periphery of the rotary table 2", which is combined with the weight block 3' on a side thereof, as shown in the detailed cross-sectional view taken along Line V-V in FIG. 10A. While the locking block 59 is in ordinary use, the screw portion 591 is screwed in one of the threaded holes 282 on the weighted rotary table 2", so that the weighted rotary table 2" assembly is in a locked state. When the weighted rotary table 2" is operated for an orientation adjustment, the locking block 59 is rotated outwards with a tool to drive the screw portion 591 to disengage from the threaded hole 282 on the periphery of the weighted rotary table 2". Thus, the weighted rotary table 2" assembly enters a free state.

The aforementioned weighted rotary table assembly installed in the golf club head has the following advantages in making adjustment:

1. The rotary table assembly combined with the weight block can be used to adjust a distribution of different weights around 360 degrees according to a golfer's personal swing posture and a location that the golfer is used to;
2. The locking block assembly for limiting an orientation of the weighted rotary table assembly installed in the body of the golf club head can be effectively engaged or disengaged through simple procedures; and
3. As a way to restrain the orientation of the weighted rotary table assembly installed in the body of the golf club head, the ball which is provided in the body and constantly pressed upwards is resiliently engaged with a positionally corresponding one of the notches formed on the lower portion of the weighted rotary table, so as to assist in positioning the weighted rotary table assembly.

What is claimed is:

1. A weight adjusting structure of a golf club head, comprising:

a golf club head; and a weight block, wherein a 360-degree rotatable rotary table is installed in a body of the golf club head, wherein the rotary table is combined with an incomplete annular weight block at a peripheral portion on an arbitrary side thereof, so that the rotary table and the weight block form a weighted rotary table assembly whose weight orientation can be adjusted; wherein the weighted rotary table assembly installed in the body of the golf club head can be used to adjust a distribution of different weights around 360 degrees, so that a preferred location of the club head's gravity center can be set according to a golfer's swing posture and a location that the golfer is used to; and wherein the body of the golf club head has a supporting tube protruding therefrom, in which the supporting tube can cooperate with a threaded securing element and be combined with a bush, so as to be penetratingly assembled with the weighted rotary table assembly, so that the weighted rotary table assembly installed in the body of the club head enters a pivotally installed state.

2. The weight adjusting structure of the golf club head as claimed in claim 1, wherein an adjustment of the orientation of the weighted rotary table assembly installed in the body of the golf club head is limited by a locking block assembly, and the locking block assembly comprises a locking block having a pin extending from a side thereof, in which the pin is combined with a resilient element that is constantly pressed upwards, and then penetrates into the body of the club head so as to be retained by a C-shaped fastener, and an engaging portion protruding from a peripheral portion of the locking block towards an acting side thereof can be engaged with or disengaged from slots distributed around a lower periphery of the weighted rotary table; wherein, while the locking block assembly is in ordinary use, the engaging portion formed at an end of the locking block is engaged with one of the slots distributed around the lower periphery of the weighted rotary table, so that the weighted rotary table assembly is in a locked state and when the weighted rotary table assembly is operated for an orientation adjustment, the resiliently secured locking block is manually pushed upwards to drive the engaging portion protruding therefrom to disengage from the slot on the lower periphery of the weighted rotary table, so that the weighted rotary table assembly is in a free state.

3. The weight adjusting structure of the golf club head as claimed in claim 1, wherein an adjustment of the orientation of the weighted rotary table assembly installed in the body of the golf club head is limited by a locking block assembly, and the locking block assembly has a butting portion formed at an end thereof, in which the butting portion can be inserted through a gauging member providing graduated spaces and combined with a resilient element that is constantly pressed inwards, and then penetrate into a side peripheral portion of the body of the club head so as to be retained by a C-shaped fastener, so that the butting portion of the locking block is engaged with or disengaged from notches distributed around a periphery of the weighted rotary table; wherein, while the locking block assembly is in ordinary use, the butting portion of the locking block is engaged with one of the notches distributed around the periphery of the weighted rotary table, so that the weighted rotary table assembly is in a locked state and when the weighted rotary table assembly is operated for an orientation adjustment, the locking block which is resiliently pressed inwards is rotated with a tool to drive the gauging member with the graduated spaces to rotate to a smallest spacing, so that the butting portion of the locking block is disengaged from the notch on the periphery of the weighted rotary table, and the weighted rotary table assembly is therefore in a free state.

4. The weight adjusting structure of the golf club head as claimed in claim 1, wherein an adjustment of the orientation of the weighted rotary table assembly installed in the body of the golf club head is limited by a locking block, in which a screw portion formed at an end of the locking block can directly penetrate into a side peripheral portion of the body of the club head, so that the screw portion of the locking block is screwed in or out of threaded holes distributed around a periphery of the weighted rotary table; and whereby, while the locking block is in ordinary use, the screw portion is screwed in one of the threaded holes distributed around the periphery of the weighted rotary, so that the weighted rotary table assembly is in a locked state and when the weighted rotary table assembly is operated for an orientation adjustment, the locking block is rotated outwards with a tool to drive the screw portion to disengage from the threaded hole on the periphery of the weighted rotary table, so that the weighted rotary table assembly is in a free state.

5. The weight adjusting structure of the golf club head as claimed in claim 1, wherein the weighted rotary table assembly installed in the body of the golf club head is covered on a top portion thereof with an upper body, so that the entire golf club head has a decorative top surface.

6. A weight adjusting structure of a golf club head, comprising:

a golf club head; and a weight block, wherein a 360-degree rotatable rotary table is installed in a body of the golf club head, wherein the rotary table is combined with an incomplete annular weight block at a peripheral portion on an arbitrary side thereof, so that the rotary table and the weight block form a weighted rotary table assembly whose weight orientation can be adjusted; wherein the weighted rotary table assembly installed in the body of the golf club head can be used to adjust a distribution of different weights around 360 degrees, so that a preferred location of the club head's gravity center can be set according to a golfer's swing posture and a location that the golfer is used to; and wherein the body of the golf club head is formed with a cavity on a side thereof for receiving a spring and a ball; and the weighted rotary table assembly is installed in the body and has a plurality of notches distributed around a lower periphery thereof, so that the ball which is received in the cavity of the body and constantly pressed upwards can be resiliently engaged with a positionally corresponding one of the notches on the lower periphery of the weighted rotary table assembly to assist in positioning the weighted rotary table assembly.

7. The weight adjusting structure of the golf club head as claimed in claim 6, wherein an adjustment of the orientation of the weighted rotary table assembly installed in the body of the golf club head is limited by a locking block assembly, and the locking block assembly comprises a locking block having a pin extending from a side thereof, in which the pin is combined with a resilient element that is constantly pressed upwards, and then penetrates into the body of the club head so as to be retained by a C-shaped fastener, and an engaging portion protruding from a peripheral portion of the locking block towards an acting side thereof can be engaged with or disengaged from slots distributed around a lower periphery of the weighted rotary table; wherein, while the locking block assembly is in ordinary use, the engaging portion formed at an end of the locking block is engaged with one of the slots distributed around the lower periphery of the weighted rotary table, so that the weighted rotary table assembly is in a locked state and when the weighted rotary table assembly is operated for an orientation adjustment, the resiliently secured locking block is manually pushed upwards to drive the engaging portion protruding therefrom to disengage from the slot on the lower periphery of the weighted rotary table, so that the weighted rotary table assembly is in a free state.

8. The weight adjusting structure of the golf club head as claimed in claim 6, wherein an adjustment of the orientation of the weighted rotary table assembly installed in the body of the golf club head is limited by a locking block assembly, and the locking block assembly has a butting portion formed at an end thereof, in which the butting portion can be inserted through a gauging member providing graduated spaces and combined with a resilient element that is constantly pressed inwards, and then penetrate into a side peripheral portion of the body of the club head so as to be retained by a C-shaped fastener, so that the butting portion of the locking block is engaged with or disengaged from notches distributed around a periphery of the weighted rotary table; wherein, while the locking block assembly is in ordinary use, the butting portion of the locking block is engaged with one of the notches distributed around the periphery of the weighted rotary table, so that the weighted rotary table assembly is in a locked state and when the weighted rotary table assembly is operated for an orientation adjustment, the locking block which is resiliently pressed inwards is rotated with a tool to drive the gauging member with the graduated spaces to rotate to a smallest spacing, so that the butting portion of the locking block is disengaged from the notch on the periphery of the weighted rotary table, and the weighted rotary table assembly is therefore in a free state.

9. The weight adjusting structure of the golf club head as claimed in claim 6, wherein an adjustment of the orientation of the weighted rotary table assembly installed in the body of the golf club head is limited by a locking block, in which a screw portion formed at an end of the locking block can directly penetrate into a side peripheral portion of the body of the club head, so that the screw portion of the locking block is screwed in or out of threaded holes distributed around a periphery of the weighted rotary table; and whereby, while the locking block is in ordinary use, the screw portion is screwed in one of the threaded holes distributed around the periphery of the weighted rotary, so that the weighted rotary table assembly is in a locked state and when the weighted rotary table assembly is operated for an orientation adjustment, the locking block is rotated outwards with a tool to drive the screw portion to disengage from the threaded hole on the periphery of the weighted rotary table, so that the weighted rotary table assembly is in a free state.

10. The weight adjusting structure of the golf club head as claimed in claim 6, wherein the weighted rotary table assembly installed in the body of the golf club head is covered on a top portion thereof with an upper body, so that the entire golf club head has a decorative top surface.

11. A weight adjusting structure of a golf club head, comprising:

a golf club head;

a weight block; and a locking block assembly, wherein a 360-degree rotatable rotary table is installed in a body of the golf club head, wherein the rotary table is combined with an incomplete annular weight block at a peripheral portion on an arbitrary side thereof, so that the rotary table and the weight block form a weighted rotary table assembly whose weight orientation can be adjusted; wherein the weighted rotary table assembly installed in the body of the golf club head can be used to adjust a distribution of different weights around 360 degrees, so that a preferred location of the club head's gravity center can be set according to a golfer's swing posture and a location that the golfer is used to; wherein an adjustment of the orientation of the weighted rotary table assembly installed in the body of the golf club head is limited by the locking block assembly, and the locking block assembly comprises a locking block having a pin extending from a side thereof, in which the pin is combined with a resilient element that is constantly pressed upwards, and then penetrates into the body of the club head so as to be retained by a C-shaped fastener, and an engaging portion protruding from a peripheral portion of the locking block towards an acting side thereof can be engaged with or disengaged from slots distributed around a lower periphery of the weighted rotary table; wherein, while the locking block assembly is in ordinary use, the engaging portion formed at an end of the locking block is engaged with one of the slots distributed around the lower periphery of the weighted rotary table, so that the weighted rotary table assembly is in a locked state and when the weighted rotary table assembly is operated for an orientation adjustment, the resiliently secured locking block is manually pushed upwards to drive the engaging portion protruding therefrom to disengage from the slot on the lower periphery of the weighted rotary table, so that the weighted rotary table assembly is in a free state.

12. The weight adjusting structure of the golf club head as claimed in claim 11, wherein the weighted rotary table assembly installed in the body of the golf club head is covered on a top portion thereof with an upper body, so that the entire golf club head has a decorative top surface.

13. A weight adjusting structure of a golf club head, comprising:

a golf club head;

a weight block; and a locking block assembly, wherein a 360-degree rotatable rotary table is installed in a body of the golf club head, wherein the rotary table is combined with an incomplete annular weight block at a peripheral portion on an arbitrary side thereof, so that the rotary table and the weight block form a weighted rotary table assembly whose weight orientation can be adjusted; wherein the weighted rotary table assembly installed in the body of the golf club head can be used to adjust a distribution of different weights around 360 degrees, so that a preferred location of the club head's gravity center can be set according to a golfer's swing posture and a location that the golfer is used to; wherein an adjustment of the orientation of the weighted rotary table assembly installed in the body of the golf club head is limited by the locking block assembly, and the locking block assembly has a butting portion formed at an end thereof, in which the butting portion can be inserted through a gauging member providing graduated spaces and combined with a resilient element that is constantly pressed inwards, and then penetrate into a side peripheral portion of the body of the club head so as to be retained by a C-shaped fastener, so that the butting portion of the locking block is engaged with or disengaged from notches distributed around a periphery of the weighted rotary table; wherein, while the locking block assembly is in ordinary use, the butting portion of the locking block is engaged with one of the notches distributed around the periphery of the weighted rotary table, so that the weighted rotary table assembly is in a locked state and when the weighted rotary table assembly is operated for an orientation adjustment, the locking block which is resiliently pressed inwards is rotated with a tool to drive the gauging member with the graduated spaces to rotate to a smallest spacing, so that the butting portion of the locking block is disengaged from the notch on the periphery of the weighted rotary table, and the weighted rotary table assembly is therefore in a free state.

14. The weight adjusting structure of the golf club head as claimed in claim 13, wherein the weighted rotary table assembly installed in the body of the golf club head is covered on a top portion thereof with an upper body, so that the entire golf club head has a decorative top surface.

* * * * *